US010864429B2

(12) United States Patent
Dreifus

(10) Patent No.: US 10,864,429 B2
(45) Date of Patent: Dec. 15, 2020

(54) SNOWBOARD HOOK

(71) Applicant: Shred Hook, Inc., South Lake Tahoe, CA (US)

(72) Inventor: Kyle Dreifus, South Lake Tahoe, CA (US)

( * ) Notice: Subject to any disclaimer, the term of this patent is extended or adjusted under 35 U.S.C. 154(b) by 0 days.

(21) Appl. No.: 15/855,827

(22) Filed: Dec. 27, 2017

(65) Prior Publication Data

US 2019/0262693 A1 Aug. 29, 2019

(51) Int. Cl.
*A63C 10/14* (2012.01)
*A63C 10/28* (2012.01)

(52) U.S. Cl.
CPC ..... *A63C 10/285* (2013.01); *A63C 10/14* (2013.01)

(58) Field of Classification Search
CPC ..... A63C 10/14; A63C 10/28; A63C 10/258
See application file for complete search history.

(56) References Cited

U.S. PATENT DOCUMENTS 5,356,159 A * 10/1994 Butterfield ..... A63C 10/28 280/14.22
6,290,260 B1 * 9/2001 Brill ..... A63C 10/28 280/809
7,219,930 B2 * 5/2007 Kiernan ..... A63C 10/10 280/14.21
2004/0032122 A1 * 2/2004 Giannulli ..... A63C 10/28 280/809
2010/0283226 A1 * 11/2010 Metchik ..... A63C 5/03 280/623
2015/0290525 A1 * 10/2015 Hofmann ..... A63C 10/28 280/14.22
2016/0030830 A1 * 2/2016 Rice ..... A63C 10/28 280/809

* cited by examiner

*Primary Examiner* — Bryan A Evans
(74) *Attorney, Agent, or Firm* — Womble Bond Dickison; Bill Jacobs

(57) ABSTRACT

A snowboard hook including a flat bottom component, to be secured to a top surface of a snowboard, and a curved top component, wherein a bottom edge of the curved top component is orthogonally coupled to a first edge of the flat bottom component. The curved top component includes: a vertical portion, including the bottom edge of the curved top component; and a horizontal portion, wherein the horizontal portion protrudes in a curved manner from the vertical portion to an approximately horizontal position near a top edge of the curved top component.

20 Claims, 5 Drawing Sheets

SNOWBOARD HOOK

TECHNICAL FIELD

The present disclosure relates to the field of sports equipment and more specifically, to a removable hook for use in snowboarding applications.

BACKGROUND

Snowboarding is a relatively young sport that is growing in popularity across the world. As more people continue to learn to snowboard, snowboarding technology, which has barely changed since its conception, is due for an upgrade. Typical snowboard equipment may consist of a snowboard, usually made from fiberglass and wood, a pair of bindings attached to the snowboard, and boots for the user's feet. Snowboard bindings, secured to the snowboard, allow a user to fasten his or her boots to the snowboard.

BRIEF DESCRIPTION OF THE DRAWINGS

Various implementations of the present disclosure will be understood more fully from the detailed description given below and from the accompanying drawings of various implementations of the invention.

DETAILED DESCRIPTION

Figure 1A:
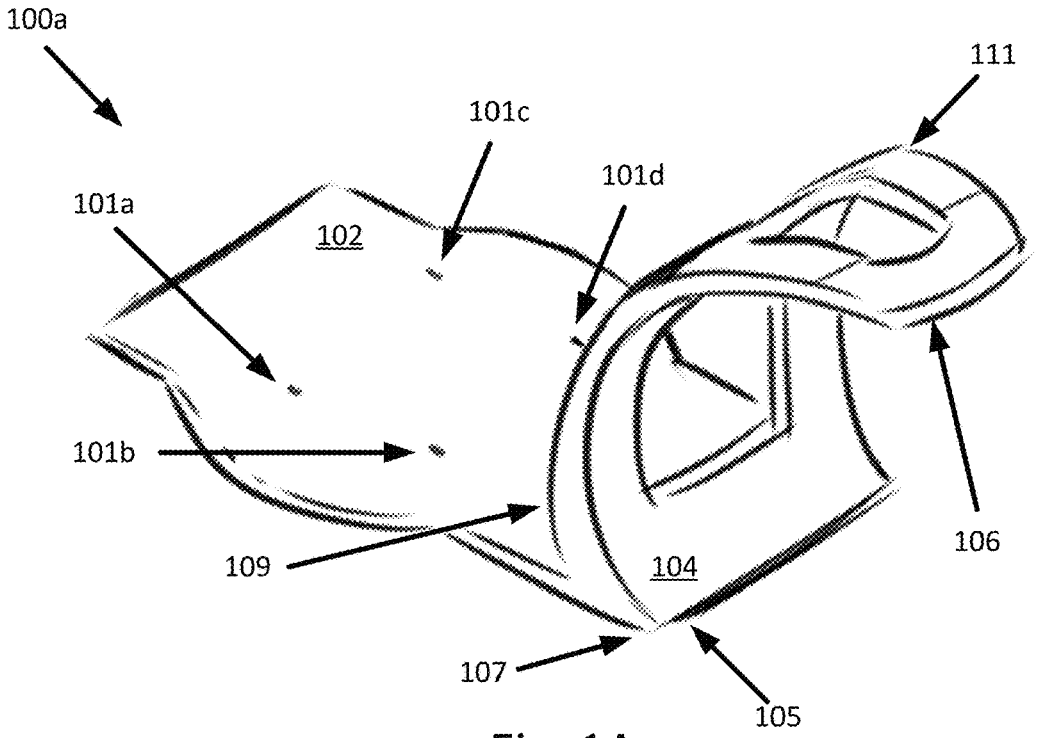
FIG. 1A depicts a first view of a snowboard hook, according to an implementation.

Traditional snowboarding gear may include a snowboard, a pair of snowboard bindings (e.g., "bindings") attached to the snowboard, and snowboard boots (e.g., "boots"). In one embodiment, snowboard bindings are secured to the snowboard via screws or some other fastener. Snowboard bindings may include various straps to secure a snowboarder's boot. Alternatively, some snowboard bindings include a mechanical lock, which may be used to secure a specially-made snowboarding boot to the binding). Snowboard bindings are notoriously difficult to get in and out of, often resulting in a snowboarder spending a minute or two sitting on a bench or the ground every time he or she wishes to secure his or her feet (e.g., "strap in").

Because both feet are held in a set position by the bindings, snowboarders must unstrap and re-strap one or both feet from their snowboard bindings to perform tasks such as: traverse the mountain by "pedaling" their back foot, ride a short distance over flat ground, get on and off chairlifts, etc. The constant effort of securing and unsecuring one or both feet from bindings can be cumbersome, tiresome, and even dangerous. Furthermore, having both feet secured in these types of bindings may limit the variety of tricks that a snowboarder may perform.

In one embodiment, a stomp pad may be placed on the snowboard near one of the bindings (usually on the inside of the back foot) to aid in providing traction for a snowboarder's foot while not secured in a binding. Stomp pads may be made of rubber, metal, or some other material, and may be attached to the top of a snowboard, usually via a strong adhesive. Stomp pads may help a snowboarder maneuver around the snow while strapped into only one binding by providing a non-slip area, on which a snowboarder may rest his or her unsecured foot. Stomp pads may be limited, however, in that they rely solely on downward friction to secure a snowboarder's foot, which may be unreliable. Many snowboarders fall, even while using a stomp pad, because their foot slips from the stomp pad. Furthermore, a stomp pad may not allow a snowboarder to perform more complicated one-footed tricks, which may rely on a snowboarder's foot being secured, but easily unsecured, and vice versa, from the snowboard.

Embodiments of the present disclosure address the above challenges by providing a snowboard hook (also referred to herein as a "snowboard binding hook" for convenience). A snowboard hook may allow a snowboarder to easily and quickly secure and unsecure one or both feet from snowboard bindings, while maintaining a high level of security since the snowboard hook extends over the top of a snowboarder's boot.

In one embodiment, a snowboard hook may include a flat bottom component, to be secured to a top surface of a snowboard, and a curved top component, wherein a bottom edge of the curved top component is orthogonally coupled to a first edge of the flat bottom component. The curved top component may include: a vertical portion, including the bottom edge of the curved top component; and a horizontal portion. The horizontal portion may extend in a curved manner from the vertical portion to an approximately horizontal position near a top edge of the curved top component. Various other embodiments of the snowboard hook (e.g., attached directly to bindings, included as part of bindings, etc.) are also presented herein.

The following detailed description refers to the accompanying drawings. The same reference numbers may be used in different drawings to identify the same or similar elements. In the following description, for purposes of explanation and not limitation, specific details are set forth such as particular structures, architectures, interfaces, techniques, etc. in order to provide a thorough understanding of the various aspects of the claimed disclosure. However, various aspects of the disclosed embodiments may be practiced in other examples that depart from these specific details. In certain instances, descriptions of well-known devices and methods are omitted so as not to obscure the description of the present disclosure with unnecessary detail. Furthermore, while the present embodiments described herein reference a snowboard hook of a particular shape and having particular dimensions for convenience, the embodiments described herein relate to any shape and size snowboard hook.

Figure 2:
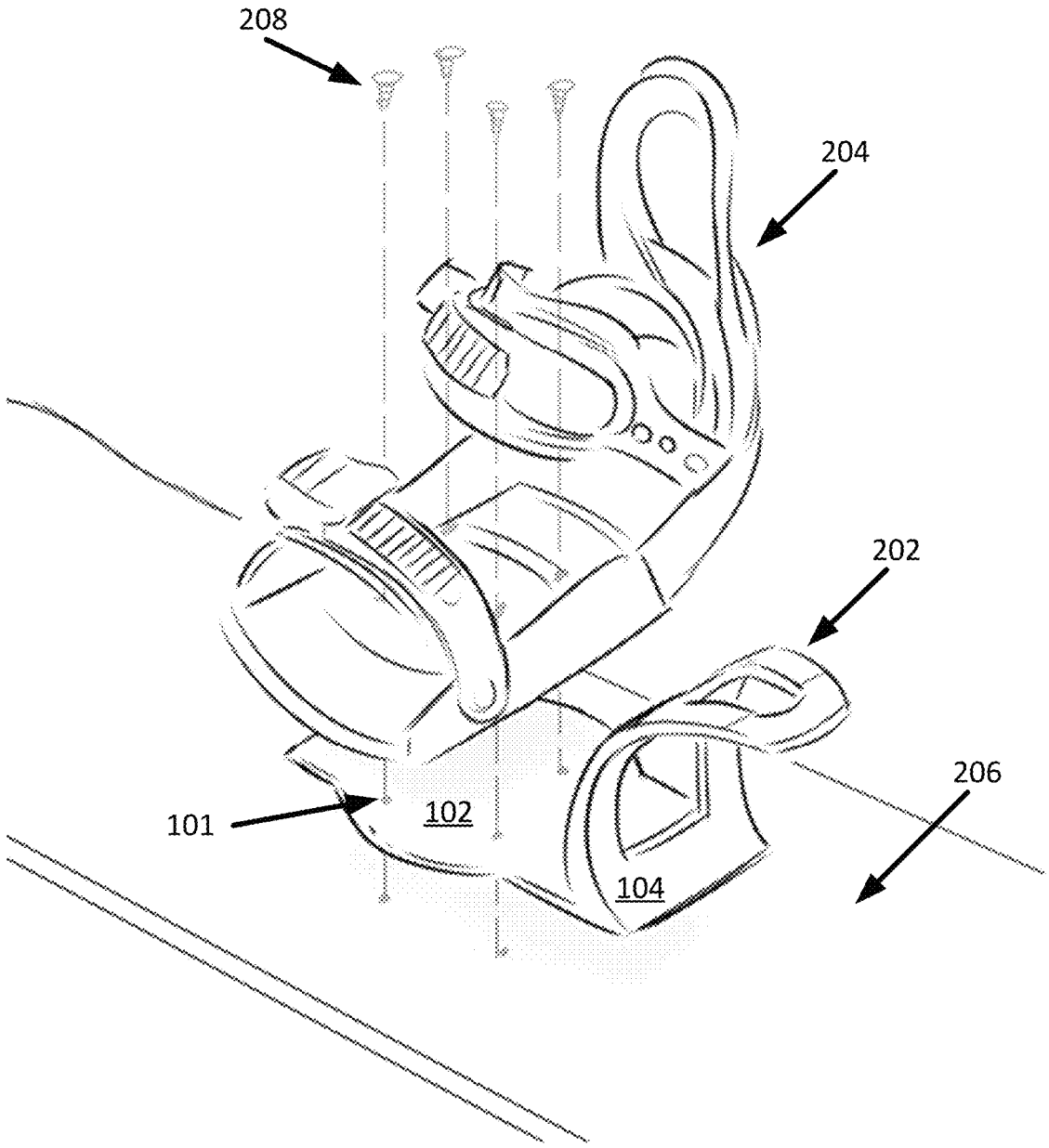
FIG. 2 depicts placement of a snowboard hook between a snowboard binding and a snowboard, according to an implementation.

FIG. 1A depicts a first view of a snowboard binding hook 100*a*, according to an implementation. In one embodiment, snowboard hook 100*a* may include a flat bottom component 102 and a curved top component 104. In one embodiment, bottom component 102 may be secured to a top surface of a snowboard (e.g., between the top surface of the snowboard and a bottom surface of bindings, as shown in FIG. 2) via fasteners. To provide clearance for such fasteners, bottom component 102 may include holes (e.g., voids) 101*a-d*.

A bottom edge 105 of the top component 104 may be orthogonally coupled to (e.g., joined with, fastened to, etc.)

a first edge (or top surface) 107 of the flat bottom component. It should be noted that the bottom component 102 and the top component 104 may be manufactured as one component. The differentiation between bottom component 102 and top component 104 as referenced herein may be solely for convenience in describing various areas of the snowboard hook. Alternatively, the bottom component 102 and the top component 104 may be separately manufactured and later combined.

In one embodiment, the top component 104 includes a vertical portion 109 and a horizontal portion 111. It should be noted that the vertical portion 109 and the horizontal portion 111 may be manufactured as one component. The differentiation between vertical portion 109 and the horizontal portion 111 as referenced herein may be solely for convenience in describing various areas of the snowboard hook. Alternatively, the vertical portion 109 and the horizontal portion 111 may be separately manufactured and later combined. In one embodiment, vertical portion 109 and the horizontal portion 111 may be separate components, joined via a locking or non-locking hinge. Advantageously, having a hinge between vertical portion 109 and the horizontal portion 111 may allow horizontal portion 111 to be stored in a vertical position and used in a horizontal position when desired.

In one embodiment, the horizontal portion 111 protrudes (e.g., extends) in a curved manner from the vertical portion 109 to an approximately horizontal position near a top edge 106 of the curved top component 104. In one embodiment, top edge 106 is opposite bottom edge 105, as shown. Top edge 106 may be shorter than bottom edge 105, such that top component 104 tapers in width from bottom edge 105 to top edge 106.

As described herein, top component 104 may be design with dimensions such that a snowboarder's boot may be held in place against vertical portion 109 and under horizontal portion 111. The specific curvature radius of the top component 104 may be any dimension, to accommodate boots of various sizes. In one example, the curvature radius may be in the range of five to ten inches. In another embodiment, any other curvature radius may be used. In yet another embodiment, top component 104 may have a non-uniform curve (e.g., one not described by a single curvature radius). Snowboard hook 100*a* may include various other components and features, as described with respect to FIG. 1B.

Figure 1B:
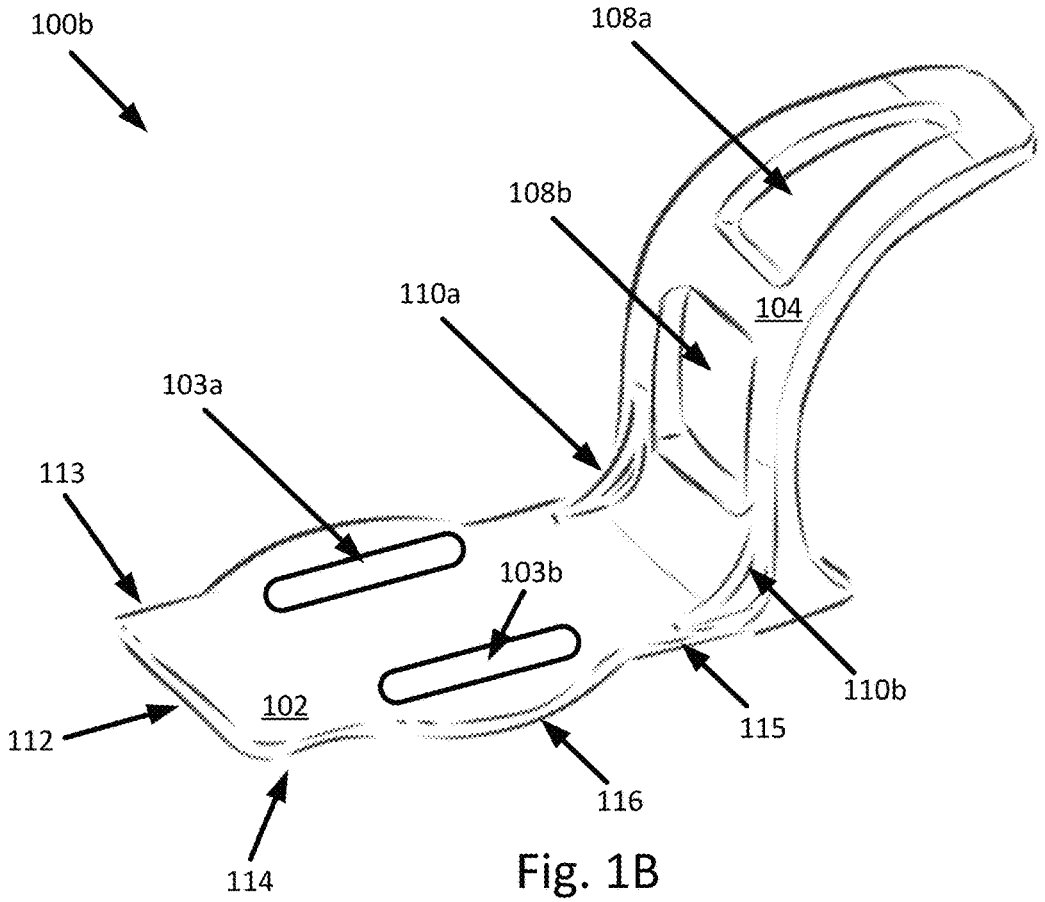
FIG. 1B depicts a second view of a snowboard hook, according to an implementation.

FIG. 1B depicts a second view of a snowboard binding hook 100*b*, according to an implementation. Snowboard hook 100*b* may be the same or a different snowboard hook as snowboard hook 100*a*.

In one embodiment, snowboard hook 100*b* includes flat bottom component 102 and curved top component 104. Snowboard hook 100*b* may include holes (e.g., voids) of various oblong sizes 103*a*, 103*b*. Advantageously, having oblong voids 103*a*, 103*b* may allow for fine-tuned positional adjustment of snowboard hook 100*b* on a snowboard. In one embodiment, top component 104 may include one or more weight-saving voids (e.g., 108*a*, 108*b*). Advantageously, weight-saving voids may allow for lighter weight of snowboard hook 100*b* while preserving structural integrity. In one embodiment, snowboard hook 100*b* may include one or more support components 110*a*, 110*b* coupled between the flat bottom component 102 and the curved top component 104. Advantageously, support components 110*a*, 110*b* may provide additional structural support to top component 104.

In one embodiment, bottom component 102 may include a second edge 112, opposite the first edge (e.g., 105 of FIG. 1A). Bottom component 102 may include a third edge 113 and a fourth edge 114. The third edge and the fourth edge may be orthogonal to the first edge 107 and the second edge 112, as shown. In one embodiment, the third edge 113 and the fourth edge 114 each include flat portions (e.g., 115) and curved portions (e.g., 116).

Figure 1C:
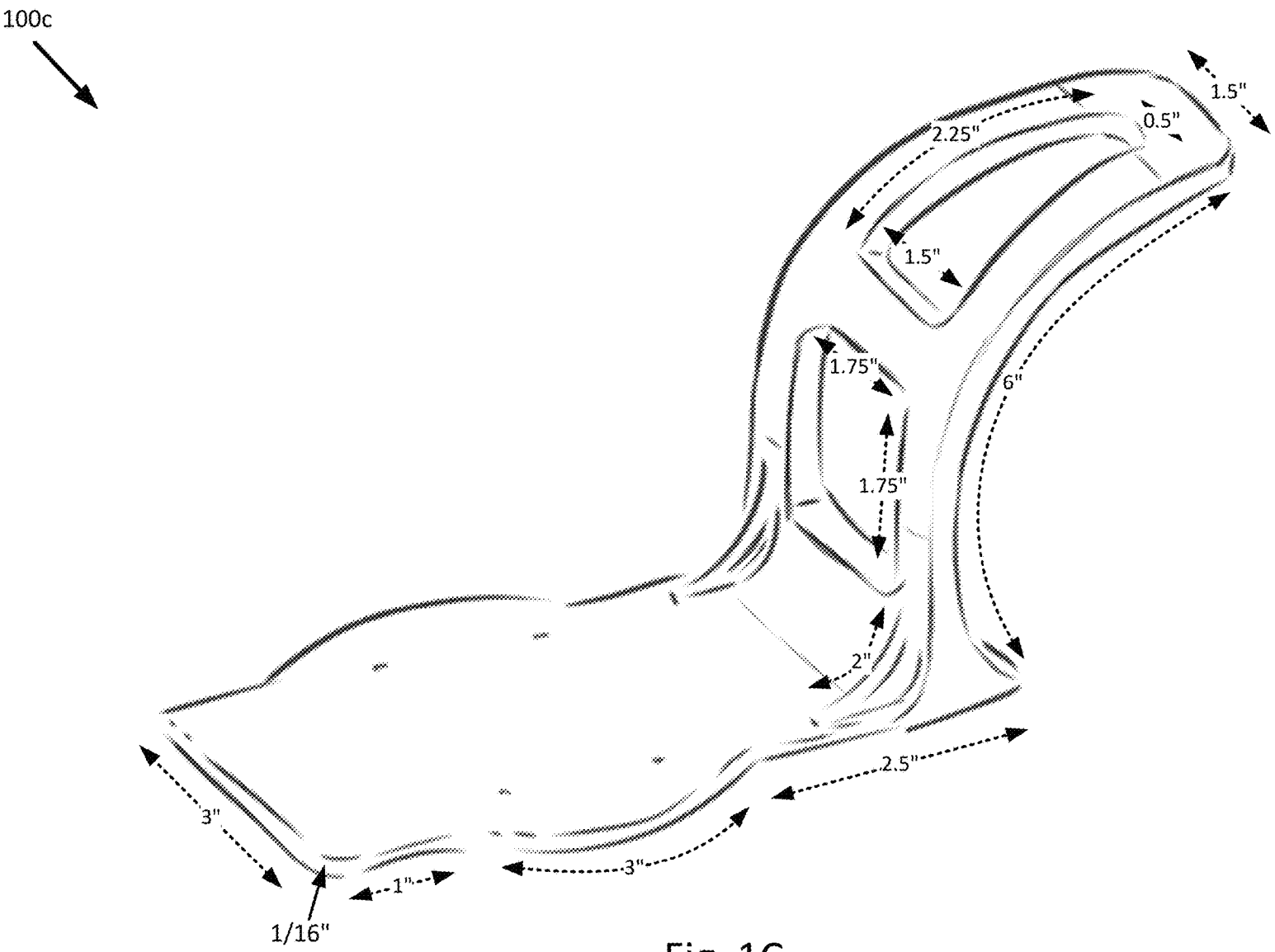
FIG. 1C depicts a view of a snowboard hook including approximate dimensions, according to an implementation.

FIG. 1C depicts a view of a snowboard binding hook 100*c* including approximate dimensions, according to an implementation. In one embodiment, the snowboard hook described herein has the approximate dimensions described in FIG. 1C. In another embodiment, a snowboard hook as described herein may have dimensions grossly different from those described in FIG. 1C. It should be emphatically emphasized that the approximate dimensions described in FIG. 1C are merely for convenience and understanding and are not limiting in any way. The snowboard hook as described herein may have any dimensions to fit any snowboard, binding, and boot combination possible.

FIG. 2 depicts placement of a snowboard binding hook 202 between a snowboard binding 204 and a snowboard 206, according to an implementation. In one embodiment, bottom component 102 of snowboard binding hook 202 is to be secured between a bottom surface of binding 204 and a top surface of snowboard 206, as pictured. One or more holes (e.g., void 101) may be included in bottom portion 102 to allow fasteners 208 to penetrate through bottom portion 102 to be secured into snowboard 206.

Figure 3:
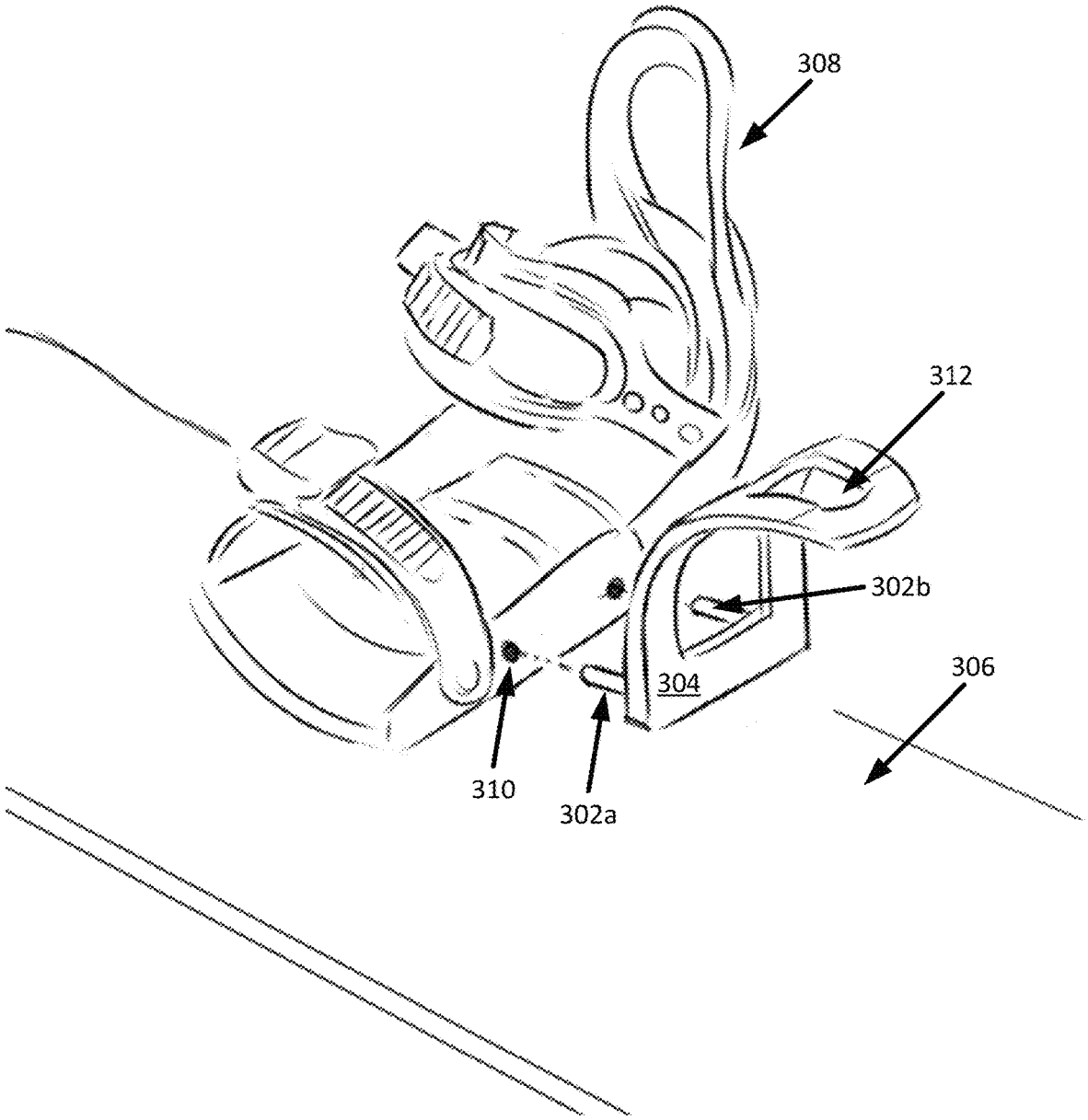
FIG. 3 depicts a first alternative snowboard hook and a snowboard binding, according to an implementation.

FIG. 3 depicts a first alternative snowboard binding hook 304 and a snowboard binding, according to an implementation. In one embodiment, snowboard hook 304 includes a curved component 304, as described herein. Curved component 304 may include a vertical portion and a horizontal portion, as described with respect to FIGS. 1A, 2B, and 1C. The vertical portion may include one or more securing components (e.g., 302*a*, 30*b*). Securing components 302*a* and 302*b* may be coupled to the curved component 304 near a bottom edge along a rear surface of the curved component. In one embodiment, the one or more securing components are to secure the snowboard hook to a snowboard binding 308, which may be secured to a snowboard 306. Securing components may be secured to bindings via friction, adhesive, fasteners, etc. In one embodiment, the securing component consists of two horizontal rods (e.g., 302*a*, 302*b*) to be secured via friction to corresponding voids in a side of the snowboard binding (e.g., 308).

In one embodiment, curved component 304 may include a horizontal portion. In one embodiment, the vertical portion and the horizontal portion are coupled via a hinge. In another embodiment, the vertical portion and the horizontal portion are merely two areas of a single component. The horizontal portion may protrude (extend) in a curved manner from the vertical portion to an approximately horizontal position near a top edge. The curved component 304 may include one or more weight-saving voids 312. In one embodiment, the curved component 304 may include a top edge, opposite a bottom edge near the securing components (310), where the top edge is shorter than the bottom edge.

Figure 4:
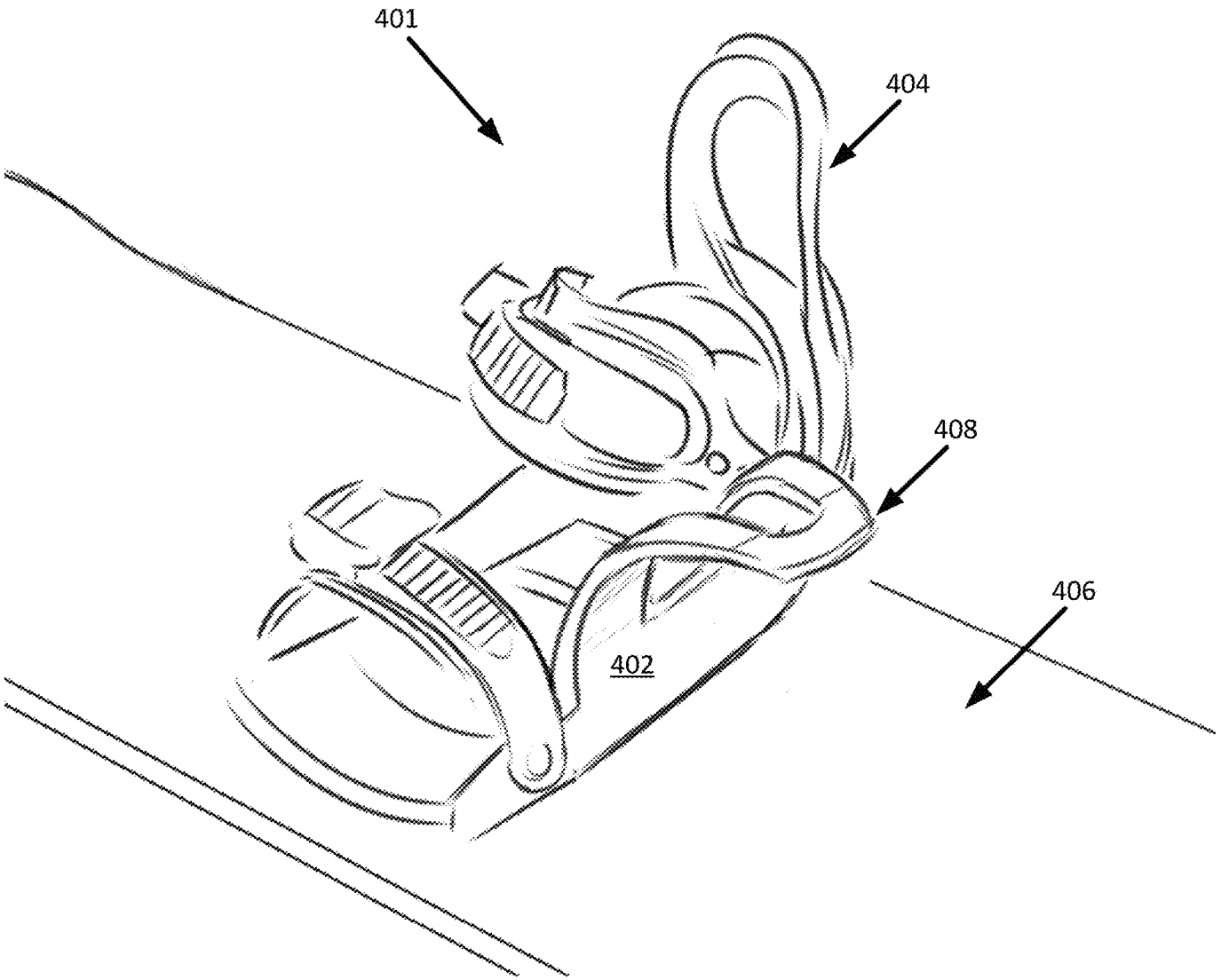
FIG. 4 depicts a second alternative snowboard hook and snowboard binding combination, according to an implementation.

FIG. 4 depicts a second alternative snowboard binding hook and snowboard binding combination 401, according to an implementation. In this embodiment, the snowboard binding hook is built into a snowboard binding. In one embodiment, the snowboard binding hook includes a snowboard binding assembly 404 and a curved component (e.g., the "hook") 402. The snowboard hook may or may not be separable from the snowboard binding assembly. The curved component 402 may include a vertical portion coupled to the snowboard binding assembly 404 near a bottom edge of the curved component 402 and along a rear surface of the curved component 402. The curved component 402 may include a horizontal portion, where the horizontal portion protrudes in a curved manner from the vertical portion to an approximately horizontal position near a top edge 408. The vertical portion and the horizontal portion may be coupled via a hinge or may be areas of a single component. As described herein, the curved component may include a weight-saving void. In one embodiment, the curved component may include the top edge 408, opposite the bottom edge, where the top edge is shorter than the bottom edge.

The various components of the snowboard hook may comprise various construction materials. For example, the snowboard hook components may be constructed from of any rigid or semi rigid plastic material, injection mold plastic, 3-D printed plastic, wood, fiberglass, metal, cardboard, foam, etc. Various coatings and/or coverings such as felt, adhesive rubber, rubberized paint, plastic, glass, foam, etc., may be applied to a base construction material. Furthermore, any fastener and adhesive type may be used in place of the fasteners described herein for convenience.

It should be noted that although the present disclosure makes reference to a "snowboard" and a "snowboard bindings," "bindings," "snowboard boots," "boots," etc., such references are merely to aid in the understanding of the present disclosure and are not a part of, nor required to be present for complete operation of the embodiments described herein.

In the description herein, numerous specific details are set forth, such as examples of specific hardware structures, specific architectural and micro architectural details, specific components, specific measurements/heights, etc. in order to provide a thorough understanding of the present disclosure. It will be apparent, however, that these specific details need not be employed to practice the present disclosure. In other instances, well known components or methods, such as specific and alternative construction materials, dimensions, shapes, sizes, functions and other specific details of the snowboard binding hook described herein have not been described in detail in order to avoid unnecessarily obscuring the present disclosure.

Use of the phrases 'to,' 'capable of/to,' and or 'operable to,' in one implementation, refers to some apparatus, system, component, component, and/or element designed in such a way to enable use of the apparatus, system, component, component, and/or element in a specified manner. Note as above that use of 'to,' 'capable to,' or 'operable to,' in one implementation, refers to the latent state of an apparatus where the apparatus is not operating but is designed in such a manner to enable use of an apparatus in a specified manner.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" on "in some embodiment" in various places throughout this specification are not necessarily all referring to the same embodiment. Furthermore, the particular features, structures, or characteristics may be combined in any suitable manner in one or more embodiment.

In the foregoing specification, a detailed description has been given with reference to specific exemplary implementations. It will, however, be evident that various modifications and changes may be made thereto without departing from the broader spirit and scope of the disclosure as set forth in the appended claims. The specification and drawings are, accordingly, to be regarded in an illustrative sense rather than a restrictive sense. Furthermore, the foregoing use of implementation and other exemplarily language does not necessarily refer to the same implementation or the same example, but may refer to different and distinct implementations, as well as potentially the same implementation.

The words "example" or "exemplary" are used herein to mean serving as an example, instance or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an embodiment" or "one embodiment" throughout is not intended to mean the same embodiment or embodiment unless described as such. Also, the terms "first," "second," "third," "fourth," etc. as used herein are meant as labels to distinguish among different elements and may not necessarily have an ordinal meaning according to their numerical designation.

What is claimed is:

1. A snowboard hook, comprising:

a flat bottom component, to be secured to a top surface of a snowboard; and a curved top component, wherein a bottom edge of the curved top component is orthogonally coupled to a first edge of the flat bottom component, the curved top component comprising:

a weight-saving void;

a vertical portion, comprising the bottom edge of the curved top component; and a horizontal portion, wherein the horizontal portion protrudes in a curved manner from the bottom edge of the vertical portion to an approximately horizontal position at a top edge of the curved top component.

2. The snowboard hook of claim 1, the flat bottom component comprising a void to provide clearance for a fastener.

3. The snowboard hook of claim 1, the flat bottom component comprising:

a second edge, opposite the first edge; and a third and a fourth edge, orthogonal to the first edge and the second edge, wherein the third edge and the fourth edge each comprise a flat portion and a curved portion.

4. The snowboard hook of claim 1, further comprising a support component coupled between the flat bottom component and the curved top component.

5. The snowboard hook of claim 1, the curved top component comprising the top edge, opposite the bottom edge, wherein the top edge is shorter than the bottom edge.

6. The snowboard hook of claim 1, consisting of a rigid plastic material.

7. The snowboard hook of claim 1, wherein the vertical portion and the horizontal portion are coupled via a hinge.

8. A snowboard hook, comprising:

a flat bottom component, to be secured to a top surface of a snowboard; and a curved top component, wherein a bottom edge of the curved top component is orthogonally coupled to a first edge of the flat bottom component, the curved top component comprising:

a vertical portion, comprising the bottom edge of the curved top component; and a horizontal portion, wherein the horizontal portion protrudes in a curved manner from the bottom edge of the vertical portion to an approximately horizontal position at a top edge of the curved top component, wherein the vertical portion and the horizontal portion are coupled via a hinge.

9. The snowboard hook of claim 8, the flat bottom component comprising a void to provide clearance for a fastener.

10. The snowboard hook of claim 8, the flat bottom component comprising:

a second edge, opposite the first edge; and a third and a fourth edge, orthogonal to the first edge and the second edge, wherein the third edge and the fourth edge each comprise a flat portion and a curved portion.

11. The snowboard hook of claim 8, further comprising a support component coupled between the flat bottom component and the curved top component.

12. The snowboard hook of claim 1, the curved top component comprising a weight-saving void.

13. The snowboard hook of claim 8, the curved top component comprising the top edge, opposite the bottom edge, wherein the top edge is shorter than the bottom edge.

14. The snowboard hook of claim 8, consisting of a rigid plastic material.

15. A snowboard hook, comprising:

a flat bottom component, to be secured to a top surface of a snowboard; and a curved top component, wherein a bottom edge of the curved top component is orthogonally coupled to a first edge of the flat bottom component, the curved top component comprising:

a weight-saving void;

a vertical portion, comprising the bottom edge of the curved top component; and a horizontal portion, wherein the horizontal portion protrudes in a curved manner from the bottom edge of the vertical portion to an approximately horizontal position at a top edge of the curved top component, wherein the vertical portion and the horizontal portion are coupled via a hinge.

16. The snowboard hook of claim 15, the flat bottom component comprising a void to provide clearance for a fastener.

17. The snowboard hook of claim 15, the flat bottom component comprising:

a second edge, opposite the first edge; and a third and a fourth edge, orthogonal to the first edge and the second edge, wherein the third edge and the fourth edge each comprise a flat portion and a curved portion.

18. The snowboard hook of claim 15, further comprising a support component coupled between the flat bottom component and the curved top component.

19. The snowboard hook of claim 15, the curved top component comprising the top edge, opposite the bottom edge, wherein the top edge is shorter than the bottom edge.

20. The snowboard hook of claim 15, consisting of a rigid plastic material.

* * * * *